US005921046A

United States Patent [19]

Hammond, Jr.

[11] Patent Number: 5,921,046

[45] Date of Patent: Jul. 13, 1999

[54] PREFABRICATED BUILDING SYSTEM FOR WALLS, ROOFS, AND FLOORS USING A FOAM CORE BUILDING PANEL AND CONNECTORS

[75] Inventor: Warren Scott Hammond, Jr., Singer Island, Fla.

[73] Assignee: Recobond, Inc., Riviera Beach, Fla.

[21] Appl. No.: 08/832,811

[22] Filed: Apr. 4, 1997

[51] Int. Cl.[6] ..... E04C 1/39; E04C 1/41

[52] U.S. Cl. ..... 52/564; 52/309.9; 52/220.2; 52/405.1; 52/439; 52/503; 52/562; 52/582.1; 52/586.1; 52/605

[58] Field of Search ..... 52/309.7, 309.9, 52/309.12, 309.13, 309.14, 309.16, 309.17, 220.2, 258, 259, 251, 503, 504, 505, 438, 439, 442, 405.1, 405.2, 405.3, 405.4, 582.1, 585.1, 586.1, 562, 564, 565, 568, 605, 607

[56] References Cited

U.S. PATENT DOCUMENTS

| | | | |
|---|---|---|---|
| 2,151,420 | 3/1939 | Carvel . | |
| 2,269,018 | 1/1942 | Guignon, Jr. | 52/405.1 X |
| 2,592,634 | 4/1952 | Wilson . | |
| 2,696,102 | 12/1954 | Zagray | 52/503 X |
| 3,292,331 | 12/1966 | Sams | 52/405.2 |
| 3,566,568 | 3/1971 | Slobodian | 52/309.7 |
| 3,755,982 | 9/1973 | Schmidt | 52/438 X |
| 3,782,049 | 1/1974 | Sachs | 52/309.7 X |
| 3,988,279 | 10/1976 | Klassen . | |
| 4,038,798 | 8/1977 | Sachs . | |
| 4,062,822 | 12/1977 | Lesage . | |
| 4,075,808 | 2/1978 | Pearlman | 52/439 |
| 4,130,536 | 12/1978 | Reighter . | |
| 4,194,919 | 3/1980 | Hattori et al. . | |
| 4,249,354 | 2/1981 | Wynn . | |
| 4,343,125 | 8/1982 | Shubow . | |
| 4,439,966 | 4/1984 | Alles . | |
| 4,523,415 | 6/1985 | Rosen . | |

(List continued on next page.)

FOREIGN PATENT DOCUMENTS

| | | | |
|---|---|---|---|
| 147005 | 6/1952 | Australia | 52/438 |
| 767681 | 7/1934 | France | 52/439 |
| 921468 | 8/1947 | France | 52/607 |
| 7408817 | 1/1976 | Netherlands | 52/309.12 |
| 289926 | 7/1953 | Switzerland | 52/564 |
| 294601 | 2/1954 | Switzerland | 52/607 |
| 601372 | 5/1948 | United Kingdom | 52/438 |

OTHER PUBLICATIONS

Dulley, James, "Foam block houses rate high", The Journal Friday Home Report, p. R22, Oct. 1988.

*Primary Examiner*—Christopher Kent
*Assistant Examiner*—Laura A. Callo
*Attorney, Agent, or Firm*—Malin, Haley, DiMaggio & Crosby, PA

[57] ABSTRACT

A building assembly for efficiently and economically constructing walls, roofs, and floors for a building assembly that utilizes a prefabricated building panel made essentially of a plastic foam core with a thin coating of plastic resin or acrylic and portland cement applied on each side for structural rigidity, the building panel having a standardized semicircular recess disposed about its perimeter for receiving pre-sized, cylindrical connectors also made of foam with a coating, and half-round connectors that connect the panel to a slab, and that also fit in the horizontal perimeter recesses of each panel. Each building panel also includes vertically disposed parallel voids that are 4 in. in diameter, spaced 2 to 4 ft. apart, that receive poured concrete or rigid piping to provide structural rigidity to the entire building assembly. The poured concrete includes rebars that are tied to the slab and are used to tie to the roof. The building panels may be used for walls and are 24 ft. long, 4 ft. wide, and 4 to 8 in. thick. Each building panel includes ¾ in. passages for receiving electrical wiring. The prefabricated building panels and connectors include end posts that are square in cross section, and are used to form floors, walls, and roofs on site in finished form through the poured concrete for structural rigidity.

10 Claims, 5 Drawing Sheets

U.S. PATENT DOCUMENTS

| | | | |
|---|---|---|---|
| 4,532,745 | 8/1985 | Kinard . | |
| 4,547,331 | 10/1985 | Batstra . | |
| 4,550,543 | 11/1985 | Valenzano . | |
| 4,613,649 | 9/1986 | Saeki et al. . | |
| 4,625,484 | 12/1986 | Oboler . | |
| 4,641,468 | 2/1987 | Slater | 52/309.7 X |
| 4,774,794 | 10/1988 | Grieb . | |
| 4,787,189 | 11/1988 | Haug et al. . | |
| 4,862,660 | 9/1989 | Raymond . | |
| 4,915,539 | 4/1990 | Yoshikane et al. . | |
| 4,924,641 | 5/1990 | Gibbar, Jr. . | |
| 5,081,810 | 1/1992 | Emmert . | |
| 5,108,679 | 4/1992 | Rirsch et al. . | |
| 5,109,088 | 4/1992 | Ohwada et al. . | |
| 5,123,222 | 6/1992 | Guarriello et al. | 52/309.12 |
| 5,162,060 | 11/1992 | Bredow et al. . | |
| 5,231,813 | 8/1993 | Drawdy | 52/605 X |
| 5,252,636 | 10/1993 | Ellenberger et al. . | |
| 5,322,562 | 6/1994 | Ellenberger et al. . | |
| 5,347,900 | 9/1994 | Ceaser et al. . | |
| 5,353,562 | 10/1994 | Decker . | |
| 5,371,990 | 12/1994 | SalahUddin . | |
| 5,393,805 | 2/1995 | Koyama et al. . | |
| 5,485,703 | 1/1996 | Nordahl | 52/562 |
| 5,488,806 | 2/1996 | Melnick et al. . | |
| 5,498,683 | 3/1996 | Kim . | |
| 5,519,971 | 5/1996 | Ramirez . | |
| 5,540,020 | 7/1996 | Santini . | |
| 5,565,535 | 10/1996 | Costin et al. . | |
| 5,566,521 | 10/1996 | Andrews et al. | 52/607 X |

PREFABRICATED BUILDING SYSTEM FOR WALLS, ROOFS, AND FLOORS USING A FOAM CORE BUILDING PANEL AND CONNECTORS

BACKGROUND OF THE INVENTION

1. Field of the Invention

This invention relates to a prefabricated building assembly for low-cost construction of walls, roofs, and floors that includes the use of a plurality of prefabricated building panels having a foam plastic core approximately 4 ft. wide and 24 ft. long and 4 to 8 in. thick, with the end faces and side faces of the building panel having prefabricated semicircular channels that engage preformed foam connectors for joining the panels together to form walls, roofs, and floors. Each panel also includes a poly-concrete coating on its outsides to provide a finish, structural strength, prevent buckling, and for weather protection. Each panel also includes a plurality of circular passages or voids that extend all the way through the thickness of the panel across the width of each panel from side to side, each of the passages being parallel and spaced between 2 to 4 ft. apart, which receive poured concrete when the panels are used to form an internal steel reinforced concrete belt in a suspended frame. Each construction panel also includes internal passages, vertically and horizontally, for utility wires.

2. Description of the Background Art

The use of foamed plastic building materials for construction of building walls, roofs, and other structures is known in the art. Attempts have also been made to reduce construction costs by implementing the overall building construction with foamed plastic materials. Building construction using combinations of polyconcrete as the basic building material is also known.

U.S. Pat. No. 4,038,798, issued Aug. 2, 1977 to Sachs, describes a composite permanent block-form for reinforced concrete construction and the method of making the same. Because of the laminate construction of Sachs, Sachs does not offer and insure sufficient structural integrity. Sachs also does not provide for a coated foam structure that uses polyconcrete.

U.S. Pat. No. 4,249,354, issued Feb. 10, 1981 to Wynn, shows a reinforced, insulated wall construction with tube liners for concrete that uses high-compressive and side-loading strengths achieved by central supporting reinforcing members in vertical passageways. Although Wynn does disclose a foamed core, the construction of the block is quite different than that described by the Applicant in Applicant's invention.

U.S. Pat. No. 4,532,745, issued Aug. 6, 1985 to Kinard, describes a channel and foam block wall construction. Concrete is poured into U-shaped channels that are formed in foam plastic blocks. The construction and operability of the blocks shown in Kinard are quite different than that described by the Applicant. Applicant's invention includes a foam core with a thin coating for structural rigidity using a polyconcrete. Voids are also preformed in Applicant's invention which are used to receive utility wires and pipes.

U.S. Pat. No. 4,774,794, issued Oct. 4, 1988 to Grieb, shows an energy efficient building system that provides a foam cement building. The Grieb building blocks include foam covered by cement which include reinforced fiberglass mesh and strands. The Grieb building block is basically a laminate and is quite different than Applicant's construction block.

U.S. Pat. No. 4,924,641, issued May 15, 1990 to Gibbar, Jr., shows a polymer building wall form for construction. The Gibbar construction includes the use of foam urethane having a series of spacers formed therein to provide for a concrete wall to be poured therein.

U.S. Pat. No. 5,488,806, issued Feb. 6, 1996 to Melnick, et al., describes block forms for receiving concrete. The construction basically uses plastic foam blocks that retain liquid concrete.

U.S. Pat. No. 4,194,919, issued Mar. 25, 1980 to Hattori, et al., describes a method for increasing flexural strength of cement compositions. The flexural strength of hydraulic cement compositions are increased by water soluble epoxy resins. There is no description in Hattori to provide a plastic foam core that is coated with the epoxy cement mixture.

U.S. Pat. No. 5,162,060, issued Nov. 10, 1992 to Bredow, et al., provides a polymer modified cement with improved chemical resistance.

U.S. Pat. No. 5,252,636, issued Oct. 12, 1993 to Ellenberger, et al., provides for a dry mixture for epoxy cement concrete. There is no description or discussion in Ellenberger to provide a foam core with a coating of epoxy resin and a cement mixture as described in Applicant's invention herein.

None of the references cited herein disclose Applicant's building block having a foam core with an integral coating of polyconcrete, nor provide a low-cost lightweight construction block that includes preformed voids for the form for steel reinforced concrete with a low-cost permanent coating that prevents lateral buckling and may include voids for utilities.

SUMMARY OF THE INVENTION

A prefabricated building assembly for constructing walls, roofs, and floors, comprising a prefabricated building panel made up of substantially a foam plastic core approximately 24 ft. long, 4 ft. wide, and from 4 to 8 in. thick.

The building panel includes 4 in. in diameter voids that extend through the thickness of each panel along its width so that when the panel is disposed horizontally each of the voids are vertically disposed to receive poured concrete and rebar. Each of the building panel 4 in. circular voids are spaced 2 to 4 ft. apart.

The end face and side face perimeter around the thickness of the building panel includes a half-round or semicircular groove or channel on all faces. The purpose of these semicircular channels is to provide connection between adjacent panels when joined together, such that a cylindrical circular connector is disposed therein for alignment and connection of adjacent panels.

The building panel includes an epoxy or acrylic resin and portland cement coating approximately ¼ in. thick on its side walls to provide strength and a finished surface to the plastic foam core of the building panel. The connector system, which includes a plurality of cylindrical, elongated members which are also made of foam that has been removed from the construction of the basic foam panel (the 4 in. voids), is also coated with the epoxy or acrylic resin and portland cement coating. The coating is also used as an adhesive along the connectors and wall interface.

The building panel also includes a plurality of small passageways, both horizontally and vertically disposed, for electrical wiring, the passageways being approximately ¾ in. in diameter.

The building assembly may be used to construct walls, roofs, and floors. The building assembly system described herein can also be used to form roof connections and a building roof with supporting trusses.

The building assembly also includes corner posts that are comprised of elongated, square foam pieces that can be 4 to 8 ft. long, having at least two sides that are adjacent to each other, coated with the resin and portland cement coating. The other sides include the semicircular or half-round channels disposed longitudinally, which also receive poured concrete vertically for stabilizing the corner post at the juncture of two walls that are formed at a 90-degree connection.

One of the purposes of the building assembly in the present invention is to take advantage of the use of styrene or urethane foam blocks as the bulk of the construction, and the fact that it can be prefabricated in a factory environment and then shipped to the building site where very little, if any, manual labor or finishing is required. The building assembly in accordance with the present invention has impact and compressive load strength and uses poured concrete for windloading and to increase the compressive strength. When using the present building assembly, the time of construction is greatly reduced. The building panels and assembly connectors are prefabricated in a factory and come in a finished condition. Labor costs on site for on-site construction is greatly reduced.

To construct almost any type of structure or building using the present building assembly, wall construction of an exterior building wall will be given for an example. After the footer and slab have been poured, the footer will contain rebar disposed substantially vertically. A building panel in accordance with the present invention will be placed on top of half-round connectors that are adhered to the slab by the plastic resin and concrete coating, while the rebar is placed through the vertical voids provided in each building panel. A second building panel will be mounted on top of the first building panel and will include cylindrical connectors disposed in the recessed channel along each of the building panel faces. Again, the epoxy or acrylic resin and portland cement coating can be used for adhering the cylindrical connectors to the recessed walls of each of the building blocks. At the 90-degree corners of the building, a corner post is used that includes a pair of semicircular recesses that match with the recess in the adjacent building walls. Concrete is poured down through the voids, which are spaced 2 to 4 ft. apart in the building panels and the end post, with the rebar progressing vertically up to the top of the wall for tying the roof down. Once the concrete is poured, the basic work for the wall is done since the wall surfaces are already finished. The same construction technique can be used for floors and roofs, as described in greater detail below. The electrical wires are then pre-placed before the concrete is poured, and at some point junction boxes can be mounted as desired. The wire chases could include telephone cable or electrical wires.

In an alternate embodiment of the building assembly, for even greater prefabrication or modular techniques that could be torn down, the poured concrete through the vertical void channels of the building walls could be replaced with a rigid piping system that can be locked in place for structural rigidity.

It is an object of this invention to provide an improved building assembly for construction of all types, including walls, floors, and roofs, using plastic expanded foam cores in conjunction with a connector system and poured concrete through channels in the building panels.

It is another object of this invention to provide a building assembly that uses foam plastic cores as building panels with a strategically determined small amount of poured concrete without reducing building windloading and compression strength.

And yet another object of the invention is to provide an entire building assembly system that utilizes styrene foam core building panels that include plastic resin and portland cement finished coatings one each side, end posts, and wall connectors to join an entire system together while using poured concrete vertically through voids in the building panels.

But still yet another object of this invention is to provide a low-cost, finished building assembly that allows prefabricated building members, such as panels, connectors, end posts, roofs, and the like to be delivered in a finished condition to the building site with minimal labor required to erect the building or wall structure through the use of poured concrete.

DESCRIPTION OF THE PREFERRED EMBODIMENT

Figure 5:
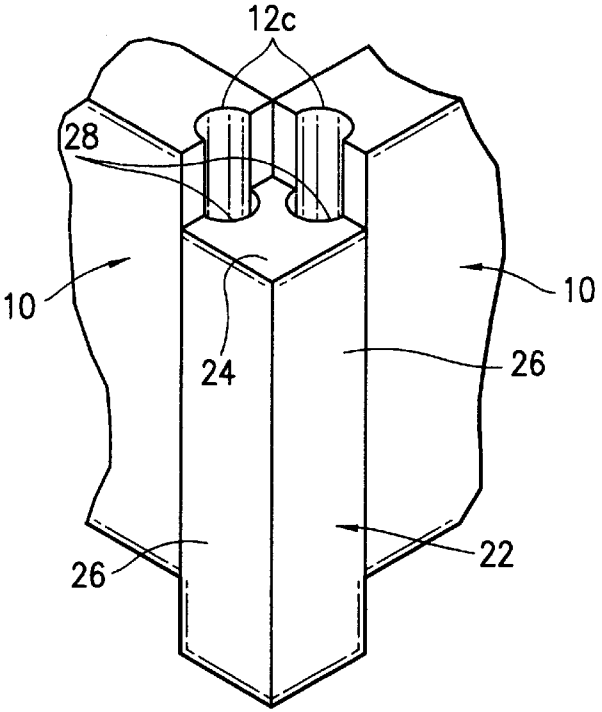
FIG. 5 shows an elevated, perspective view of a corner block in accordance with the present invention for providing an outside corner that is used with wall blocks.
Figure 15:
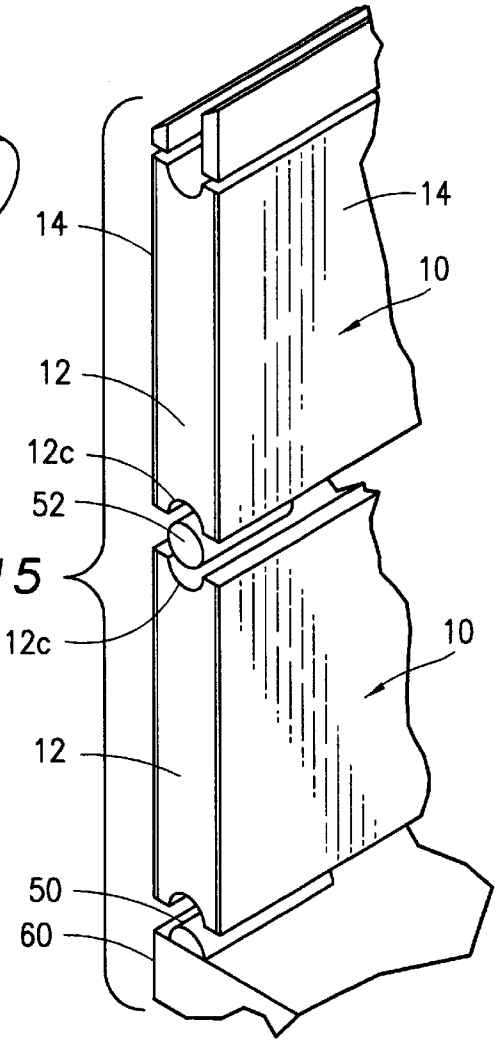
FIG. 15 shows an elevated perspective view, partially cut away, of a top and bottom basic building block.
Figure 11:
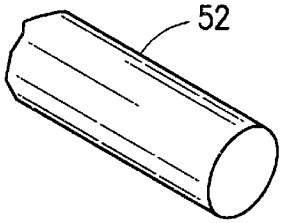
FIG. 11 shows an end perspective view, partially cut away, of a center wall connector.
Figure 10:
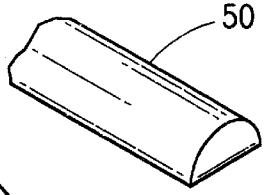
FIG. 10 shows an end perspective view, partially cut away, of a bottom wall connector.
Figure 13:
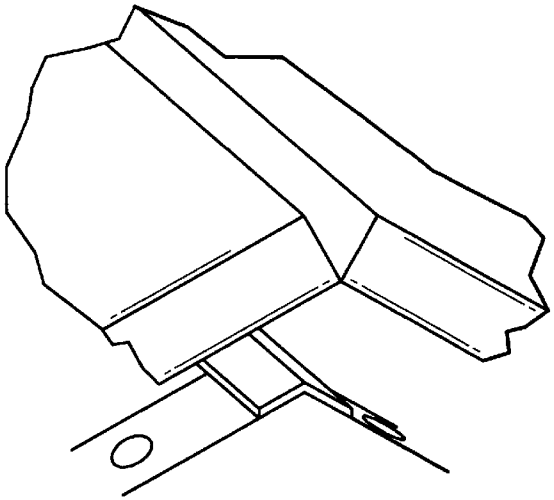
FIG. 13 shows a perspective view of a roof peak beam or truss using roof blocks.
Figure 14:
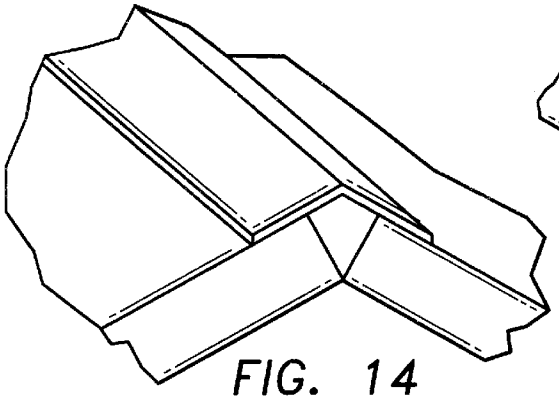
FIG. 14 shows a perspective view of a roof eave cap.
Figure 16:
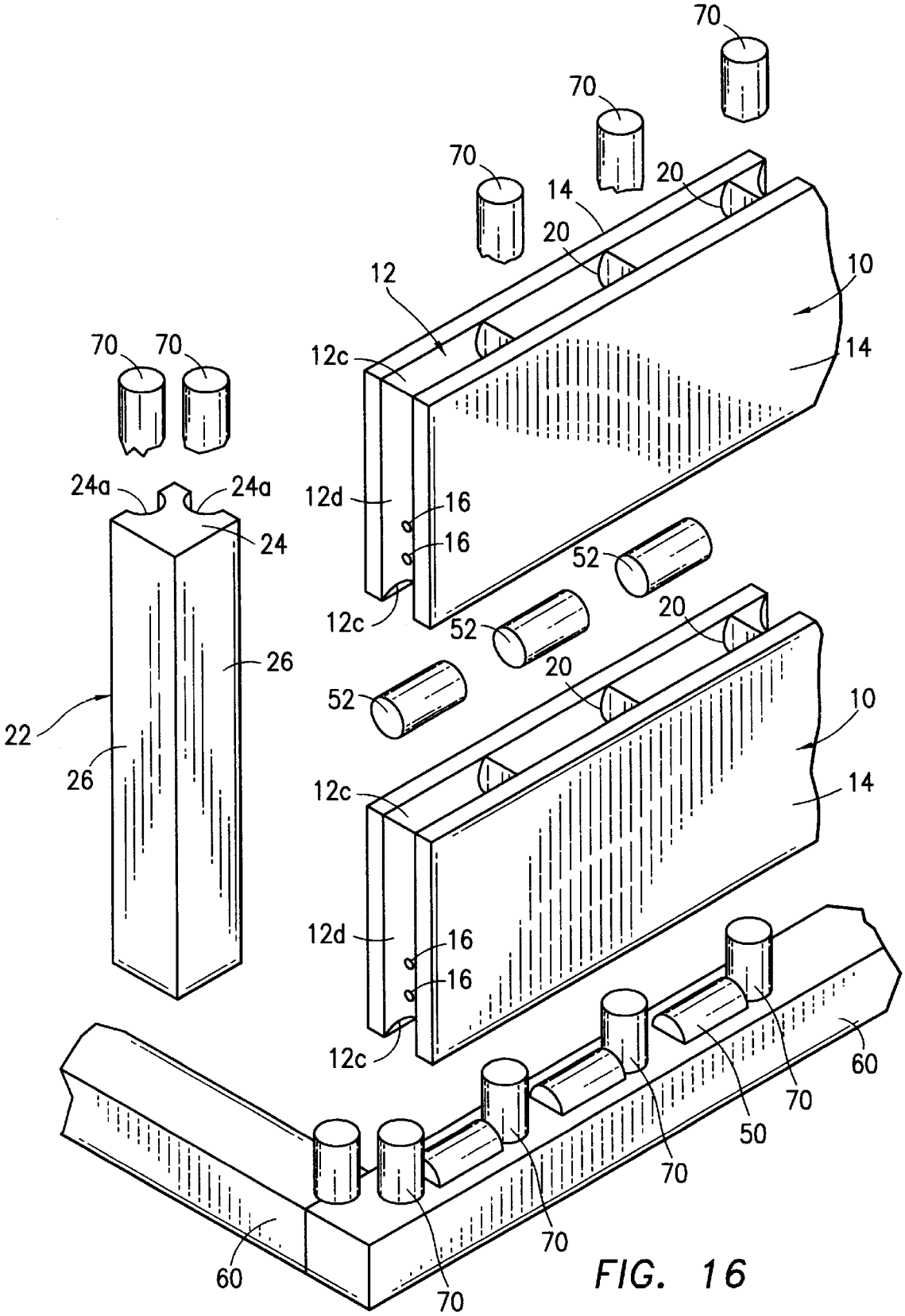
FIG. 16 shows a perspective exploded view, partially cut away, of a wall, footer, and wall post, constructed in accordance with the present invention.

The building assembly in accordance with the present invention uses a prefabricated building panel as shown in FIGS. 1–4, a corner block shown in FIG. 5, connector elements shown in FIGS. 10 and 11, and roofing accessories shown in FIGS. 13 and 14. FIGS. 15 and 16 show the overall use of the building assembly in examples.

Figure 1:
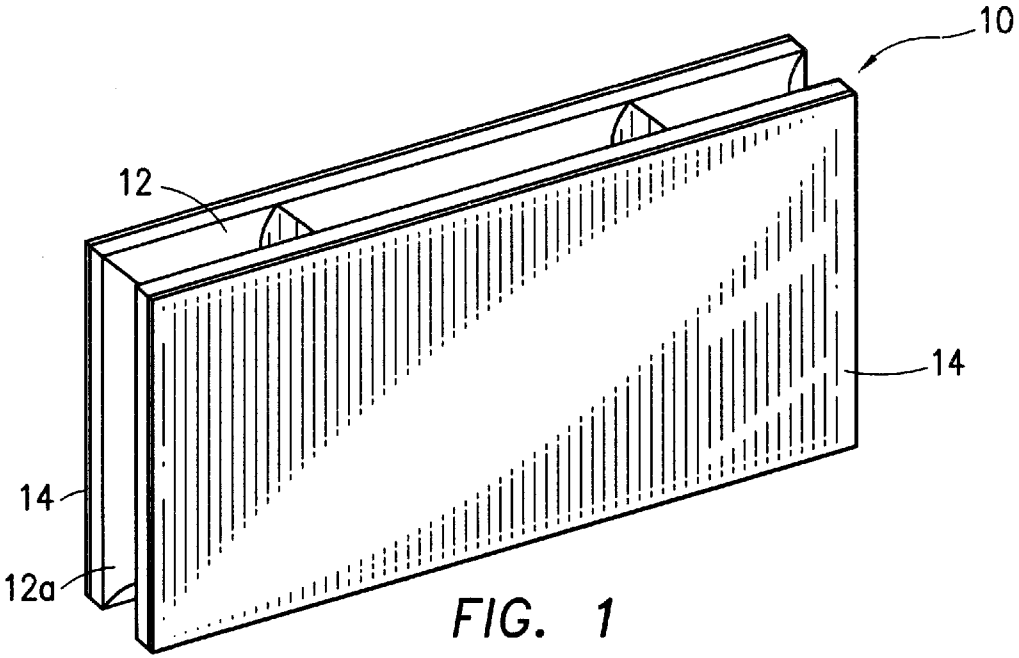
FIG. 1 shows a perspective front view of a building block formed in accordance with the present invention.

Referring now to the drawings, and in particular to FIG. 1, building panel 10 used in the present invention is shown comprised of a unitarily formed building block having a plastic foam core 12 that is coated on both large parallel sides with an epoxy resin or acrylic and concrete composite coating 14. This is the basic building panel used in the building assembly. As a particular example, this panel is typically 4 ft. wide, 24 ft. long, and between 4 and 8 in. thick. With a 4 ft. by 24 ft. building panel, two building blocks one on top of the other, thus provide for an 8 ft. high wall structure 24 ft. long.

The building panel 10 shown in FIG. 1 would be prefabricated at a factory site and shipped to a building site. An expanded styrene or urethane foam core, approximately 4 in. to 8 in. thick, rectangular in shape, and of the desired width and length, such as 4 ft. by 24 ft., is formed. The foamed plastic core includes preformed channels 12*a* which are semicircular, around all the ends of the faces of the foam core 12. Thus, if the core was 6 in. thick and there was a channel radius of 2 in. for each of the semicircular end channels, when the building panels are mated together, either on top of each other or end-to-end, then a 4 in. channel would be formed in the foamed core. The horizontal channels receive connections 50 or 52 (FIG. 10 and FIG. 11) as described below.

The epoxy resin or acrylic and cement coating 14 can be applied onto the sides or desired end portions of the styrene foam surface and manually troweled for leveling purposes. The epoxy resin or acrylic and concrete mixture will adhere directly to the surface of the styrene foam, forming an integral stress skin for lateral structure integrity to prevent buckling.

Once the coating 14 has cured and integrally affixed to the sides of the foam, the panel 10 is essentially ready for shipment to a construction site. The specific dimensions of each block could vary somewhat, depending on the building and structural factors desired, but the coating itself could be approximately ¼ in. thick relative to a 6–8 in. thick styrene foamed core.

Figure 2:
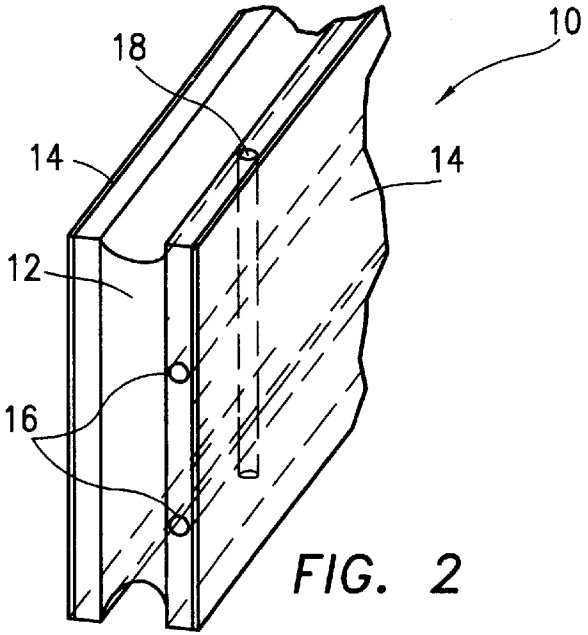
FIG. 2 shows a cut away, elevated, perspective end view of the construction block shown in FIG. 1.

FIG. 2 shows the basic building panel of FIG. 1, with the end view showing the coating 14 and the basic styrene core 12 including the semicircular, concave recessed channels along the top and end panels. The panel 10 includes a pair of tubular, ¾ in. passages 16 that go the length of the building panel, and a vertical, ¾ in. passage 18 going from top to bottom. The tubular passages 16 are positioned along the length and width of the panel and are preferably approximately 4 in. (low voltage) from the bottom, with another one being approximately 16 in. (high voltage) from the bottom. Passages or tubular holes 16 and 18 are used for wire chases. Passages 16 and 18 can be formed in core 12 by any suitable manner such as by preforming tubes during the manufacturing of the foam core, or by cutting, drilling or other method as known in the art.

Figure 3:
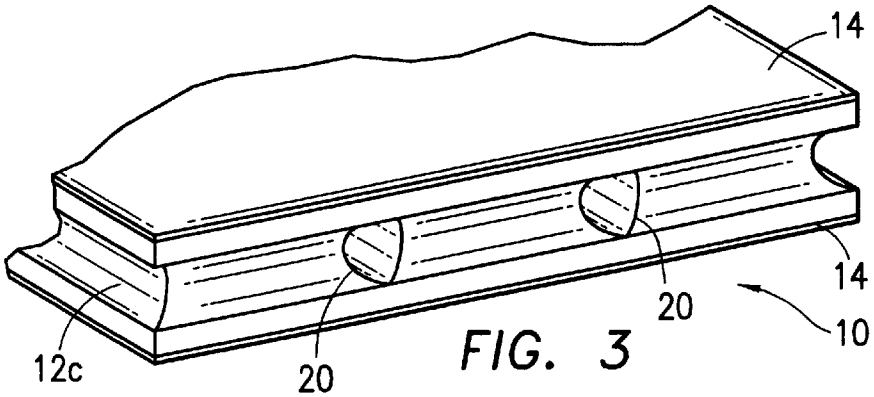
FIG. 3 shows an end, elevated, perspective view, partially cut away, of a building block in accordance with the present invention.
Figure 4:
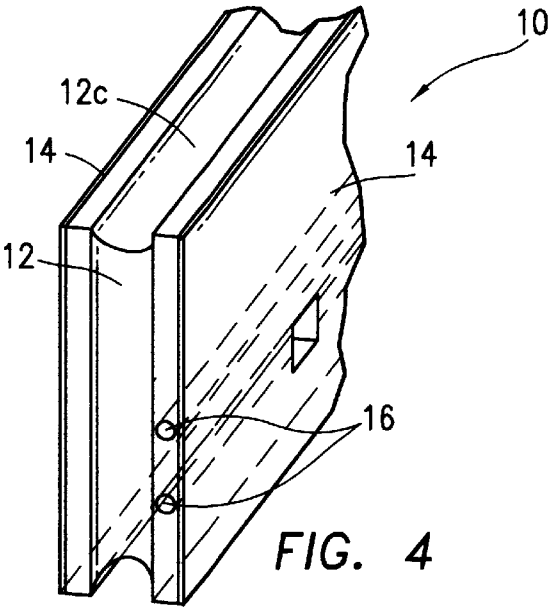
FIG. 4 shows an alternate embodiment showing an end elevated view, partially cut away, in perspective, of the building block as shown in FIG. 2.
Figure 6:
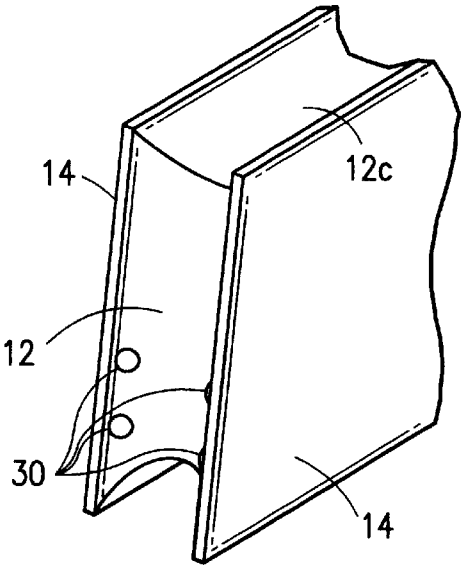
FIG. 6 shows an elevated, end, perspective view, partially cut away, of a building block in accordance with the present invention that is used as an interior panel.

FIG. 3 shows the basic building panel 10 as shown in FIG. 1 along the top, which includes a plurality of circular voids or vertical circular channels 20 that are disposed through the entire foamed core 12. The tubular channels 20 are preferably approximately 4 in. in diameter and are positioned parallel and spaced apart in the panel preferably about every 2 to 4 ft. at the factory vertically, top to bottom. Tubular channels 20 are used to receive poured concrete and rebar anchored in a slab. Half-round vertical ends 12*d* formed in foam core 12 are used for connection of the corner end post or form connecting to side-by-side panels 10 to receive poured concrete as described herein.

For the construction of each basic building panel 10, along with the styrene foamed core 12, the ¼ in. coating 14 is preferably a composition that includes either epoxy resin or acrylic and portland cement.

The coating provides lateral strength to prevent buckling and a finished surface that is weatherproof and aesthetically attractive.

EXAMPLE 1

A coating is prepared by using dry parts by weight 100.0 portland cement type 1; 300.0 sand; 10.0 silica fume or flyash; 2.5 ¾ in. propylene fibers; and 2.5 2 in. propylene fibers; comprising a total dry formula of 415.0. A wet mix epoxy is formed using 13.0 EPOTUF (37-146 water-borne epoxy resin); 15.0 EPOTUF (37-680) epoxy curing agent; 28.0 water; 1.5 nonylphenol; and 1.5 accelerator; providing a total wet weight of 66.0, which is added to the dry formula of 415.0 to form the coating. The coating is applied wet as a wet liquid mixture to the sides of the styrene block, where it readily adheres and forms an integrated block. The coating is applied approximately ¼ in. thick to the sides of the block.

EXAMPLE 2

Another coating can be prepared with the same dry parts by weight shown in Example 1, that includes an acrylic wet mix of 21.0 MC330; and 21.0 MC76; and 24.0 water, totaling 66.0 total wet formula by weight, which is added to the 415.0 total dry formula shown in Example 1, which is mixed thoroughly and applied in liquid form to the sides of the styrene foam core in approximately ¼ in. thickness.

EXAMPLE 3

Again using the dry formula shown in Example 1, a wet formula of acrylic marine mix that includes 21.0 MC330; 21.0 MC76; 12.0 CS4000; and 12.0 water, totaling 66.0 wet formula by weight, is added to the 415.0 total dry formula of Example 1 and mixed thoroughly and applied in ¼ in. thickness to the sides of the styrene foam, integrally forming the stress skin on the foam core.

Referring now to FIG. 5, a corner block is shown that is comprised of a styrene or urethane foam core 24 that includes semicircular (half-round) recesses 28 which interface with the panel 10 end face 10 with each end of semicircular recesses 12*c*. The corner block also includes a coating 26 that is permanently adhered to the styrene foam core 24 and which is the same ¼ in. coating made of epoxy or acrylic and portland cement as described above for the building panels. The corner block is also prefabricated and used on site for the building assembly. Poured concrete and rebar are used in the vertical passages 28/12*c* between the panel end and the corner block 22. Concrete is poured vertically in passages 20 in the building panel and they are attached to the slab with rebar.

Referring now to FIG. 16, the building assembly in accordance with the present invention is shown. A pair of building panels 10 are shown as they would be stacked one upon the other vertically. Each building panel would be 24 ft. long and 4 ft. wide or high. Each building panel 10 includes the finished exterior coating 14 on each side. The building panels are typically mounted on a slab 60 that contains half-round connectors 50 which are of a 2 in. radius, which are strategically positioned along the top of the slab 60 and fit perfectly into the bottom recess 12*c* of the lower panel 10. Additional adhesive material made of the coating 14 could be used on each of the half-round connectors 50. The purpose of the connectors 50 is to align the panels and to hold them into position in a straight line along the slab. The elements shown as 70 represent portions of the vertical column of poured concrete after the panels have been placed in position and are merely shown as projecting out of the slab that would include rebar. In actuality, the poured concrete element 70 would be completely filled in through both panels and passages 20 and panels 10 from the top of the wall to the bottom of the wall. The poured concrete segments 70 are also shown at the top of the wall. The two panels 10 are also joined together by cylindrically-shaped, circular fasteners 52 which are styrene foam coated with coating 14 approximately ¼ in. and that fit snugly between the upper and lower recesses in each end face of building panels 10, firmly holding and aligning the building panels together. Connectors 52 may also be additionally coated with the coating material 14 for adhesive purposes when they are joined together. Each of the building panels includes small passages 16 for high and low voltage wiring that can be passed through the panels, both horizontally and vertically.

The building assembly shown in FIG. 16 also includes an end post 22 having coating 26 on its outside faces which join together, and an inside styrene foam core 24 that includes vertically disposed, semicircular recesses 24*a*, one in each adjacent face, that interface with the wall panels at a 90-degree corner. The recesses 24*a* are also 2 in. in radius to fit perfectly with vertical recesses 12*d*. The poured concrete members also extend from the top to the bottom in the corner post 70 that include rebar for tying the corner post and the vertical wall panels together.

Figure 7:
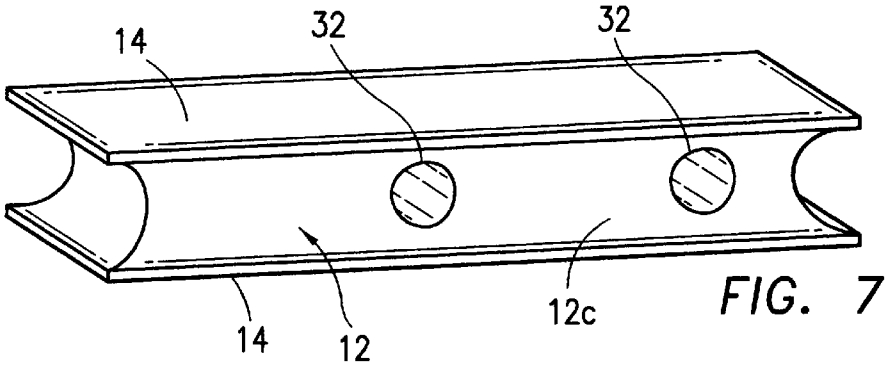
FIG. 7 shows a top end view of an interior panel as shown in FIG. 6, partially cut away, showing the internal passages.

FIG. 7 is a top perspective view of an interior building panel that can be used in the present invention. The interior panel is essentially the same as the building panel of FIG. 1, but may be only 4 in. thick.

Figure 8:
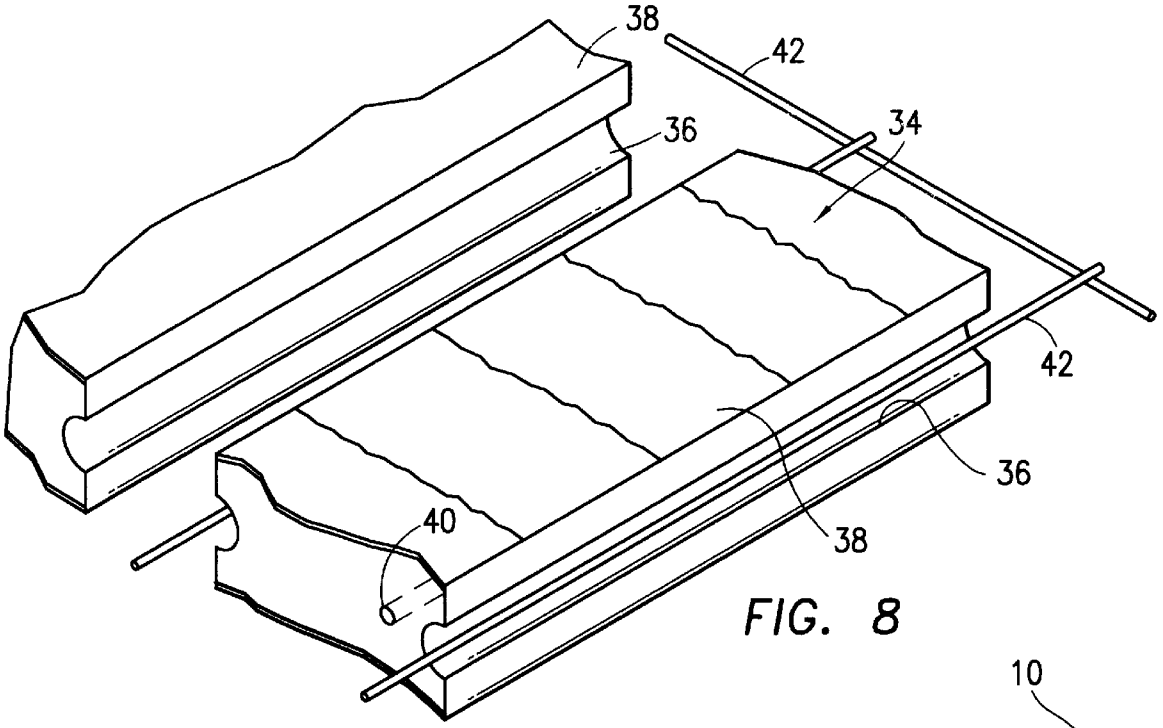
FIG. 8 shows a top perspective view of a vertical roof block.

FIG. 8 shows an elevated side view of a vertical roof building panel 34. The panel 34 may be made 6–8 in. thick, like panel 10, and is preferably 4 ft. wide, and 24 ft. long. The panel includes a 4 in. by 2 in. deep ¼ round recess 36 extending the length of the block. The block 34 also includes ¾ in. tubing 40 running the length of the block for use as a wiring chase. The connection of the roof blocks 34 provide for a concrete form matching that of the wall forms. Reinforcement bars 42, for the concrete, are placed and tied at the peak and at the wall post prior to connecting the roof blocks 34 and pouring the concrete. Block 34 can have a suitable roof exterior surface 38.

Figure 9:
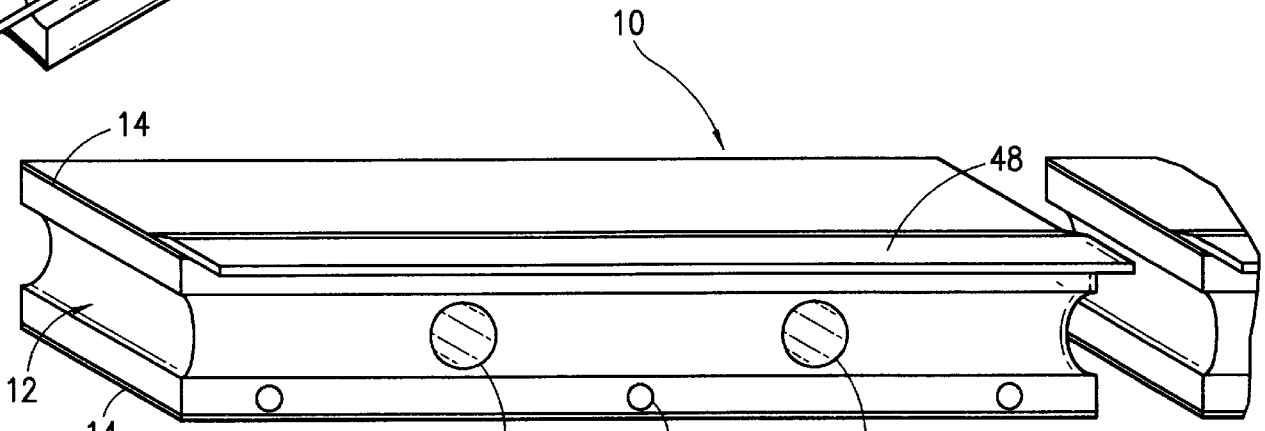
FIG. 9 shows an end elevational view in perspective, partially cut away, of a horizontal roof block.

FIG. 9 is a perspective end view of a horizontal roof block that is similar to the building panels 10 with the addition of edge connection 48. The voids 44 for receiving poured concrete and rebar extend through the block, and a ¾ in. wire chase tubular hole is provided at 46.

FIG. 10 shows a cut away view of a panel connector 50. Connector 50 is sized to fit the associated panels and for the examples herein is a 4 in. diameter by 2 in. thick hemisphere connector bonded to a slab or footer by coating material 14 prior to placing while erecting the panel. Connector 50 provides a straight and true wall connection that provides a male connector to the female recess in the bottom of the building block wall to hold it in position. Connector 50 is constructed of a styrene or urethane foam core with a ¼ in. coating 14 applied thereto.

FIG. 11 shows a center panel connector 52 that is 4 in. in diameter, circular in cross-section, cylindrical connector that is placed between two building panels 10 stacked on top of each other to form a wall. The bottom edge recess in the upper building panel 10 and the top recess along the length of the bottom building panel engage the cylindrical connector 52 so that the connector provides for a stable panel connection for both wall panels. Each connector is made of a styrene or urethane foam core with a ¼ in. coating material 14. Additional coating material can be used as an adhesive between panels 10 with each connector. The connectors are short enough so as to not interfere with the vertical passages 20 in each panel that receives poured concrete.

Figure 12:
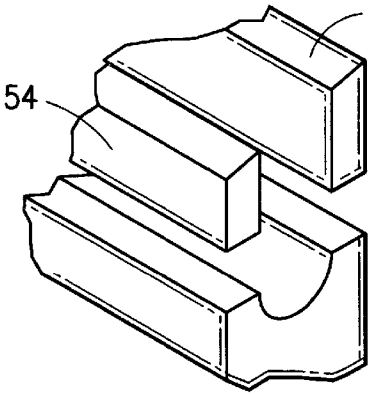
FIG. 12 shows an end perspective view, partially cut away, of a pair of top wall connectors.

FIG. 12 shows the top panel connectors 54 and 56 which utilize a peak bar that act to receive poured concrete at the top of a wall for tying to the roof panels. The connectors 54 and 56 are pre-cut in accordance with the roof pitch that is desired. They provide for a top tie beam around the perimeter of the building.

FIG. 13 shows a roof peak beam or truss, wherein the outside walls have been cut in accordance with the roof pitch. The outside panels are tied and anchored with concrete. The roof peak is placed, the first reinforcement bars are tied, and then the roof panels are placed and bonded together and repeated until the roof is complete.

FIG. 14 is an elevated side view of the roof eave cap which is placed prior to pouring roof concrete. The roof eave cap prevents roof concrete from pouring out of the roof forms and finishes the roof edges.

Using the building assembly described herein, walls, roofs, and floors can be constructed with prefabricated members conveniently and quickly and, most important, economically.

The instant invention has been shown and described herein in what is considered to be the most practical and preferred embodiment. It is recognized, however, that departures may be made therefrom within the scope of the invention and that obvious modifications will occur to a person skilled in the art.

What I claim is:

1. A building panel for forming walls, roofs and floors in a building constructed with a reinforced concrete belt in a suspended frame comprising:

an expanded foam, plastic polyhedron core having six faces substantially rectangular in shape, said first and second faces defined by the length and the width of said core, said third and fourth faces defined by the length and thickness of said core, and said fifth and sixth faces defined by the width and thickness of said core, said third, fourth, fifth and sixth faces each having a concave, semicircular recessed channel, said core also including a plurality of circular voids extending through the thickness of said core between said third and fourth face, each of said plurality of said circular voids being essentially parallel and each of said circular voids being spaced apart approximately between two feet and four feet, each of said circular voids for receiving poured concrete;

a mixture of plastic resin and cement forming a coating, integrally applied to at least said first face, said coating being approximately one quarter inch thick for added rigidity; and a first connector comprising a cylindrical, elongated member, sized in radius to fit snugly within said semicircular recessed channels in the core faces, said connector being formed of a plastic foam core with a plastic resin and portland cement coating, said connector for joining a pair of said building panels together, said connectors being sized in length to extend between said circular voids in the core that receive concrete so that said connector does not interfere with the pouring of concrete into said voids.

2. A panel for walls, roofs, and floors as in claim 1, wherein:

said building panel is approximately 4 ft. wide and 24 ft. long.

3. A panel as in claim 1, wherein:

said building panel foam expanded plastic core is made of styrene.

4. A panel as in claim 1, wherein:

said building panel plastic foam core is made of urethane.

5. A panel as in claim 1, wherein:

said plastic resin and cement coating includes portland cement, sand, silica, and polypropylene fibers applied in said ¼ in. coating.

6. A panel as in claim 1, wherein:

said coating applied to said building panel includes water-borne epoxy resin, an epoxy curing agent, water, and an accelerator, and is mixed with portland cement, sand, silica fume, and polypropylene fibers.

7. A panel as in claim 1, including:

poured concrete poured in said voids and anchored to rebar.

8. A panel as in claim 1, including:

a plurality of half-round connectors formed of semicircular members having a radius sized to fit within one of said semicircular recessed channels in the core faces for connecting said panel to a building slab.

9. A panel as in claim 1, including:

said building panel including at least one small passage disposed therethrough along its length or width for including electrical wiring.

10. A panel as in claim 1, including:

a rigid pipe system disposed within said voids for providing rigidity to said core.

* * * * *